US011674682B2

(12) United States Patent
Spiro

(10) Patent No.: US 11,674,682 B2
(45) **Date of Patent: *Jun. 13, 2023**

(54) ELONGATED MODULAR HEATSINK WITH COUPLED LIGHT SOURCE

(71) Applicant: EXPOSURE ILLUMINATION ARCHITECTS, INC., Scottsdale, AZ (US)

(72) Inventor: Daniel S. Spiro, Scottsdale, AZ (US)

(73) Assignee: EXPOSURE ILLUMINATION ARCHITECTS, INC., Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/464,417

(22) Filed: Sep. 1, 2021

(65) Prior Publication Data

US 2021/0396381 A1 Dec. 23, 2021

Related U.S. Application Data

(63) Continuation-in-part of application No. 17/397,508, filed on Aug. 9, 2021, which is a continuation-in-part of application No. 16/672,218, filed on Nov. 1, 2019, now Pat. No. 11,085,627, which is a continuation-in-part of application No. 16/019,329, filed on Jun. 26, 2018, now Pat. No. 10,502,407.

(60) Provisional application No. 62/674,431, filed on May 21, 2018.

(51) Int. Cl.

| | |
|---|---|
| ***F21V 29/76*** | (2015.01) |
| ***F21S 4/28*** | (2016.01) |
| ***F21K 9/275*** | (2016.01) |

(52) U.S. Cl.
CPC ..... *F21V 29/763* (2015.01); *F21K 9/275* (2016.08); *F21S 4/28* (2016.01)

(58) Field of Classification Search
CPC ..... F21V 15/01; F21V 29/74; F21Y 2117/10
See application file for complete search history.

(56) References Cited

U.S. PATENT DOCUMENTS

| | | | |
|---|---|---|---|
| 6,428,183 | B1 | 8/2002 | McAlpin |
| 7,959,319 | B2 | 6/2011 | Chien |
| 8,246,209 | B2 | 8/2012 | Lai |
| 8,287,144 | B2 | 10/2012 | Pedersen |
| 8,408,742 | B2 | 4/2013 | Tran |
| 8,419,223 | B2 | 4/2013 | Withers |
| 8,899,778 | B2 | 12/2014 | Yang |

(Continued)

FOREIGN PATENT DOCUMENTS

| | | |
|---|---|---|
| CN | 103244916 | 8/2013 |
| DE | 202011003828 U1 | 5/2011 |

(Continued)

OTHER PUBLICATIONS

Extended Search Report issued in Appl. No. EP19808191 (dated Jan. 27, 2022).

(Continued)

*Primary Examiner* — Leah Simone Macchiarolo
(74) *Attorney, Agent, or Firm* — Xsensus LLP

(57) ABSTRACT

An elongated heatsink structure retaining single and/or bi-directional light sources that receive variable power input(s) through at least one endcap coupled to the elongated heatsink structure.

20 Claims, 5 Drawing Sheets

(56) References Cited

U.S. PATENT DOCUMENTS

| | | | | |
|---|---|---|---|---|
| 8,998,441 | B2 * | 4/2015 | Kim | F21V 29/76 362/373 |
| 9,267,650 | B2 | 2/2016 | Simon | |
| 9,574,717 | B2 | 2/2017 | Scapa | |
| 9,644,800 | B2 | 5/2017 | Purdy | |
| 9,644,828 | B1 | 5/2017 | May | |
| 9,846,272 | B2 | 12/2017 | Dau | |
| 10,047,943 | B2 | 8/2018 | Storey | |
| 10,125,946 | B2 | 11/2018 | Meerbeek | |
| 10,203,103 | B2 | 2/2019 | Bendtsen et al. | |
| 10,378,742 | B1 | 8/2019 | Rao | |
| 10,458,638 | B1 | 10/2019 | Tirosh | |
| 10,551,046 | B1 | 2/2020 | Tang | |
| 10,845,034 | B2 | 11/2020 | Nichols | |
| 11,432,477 | B2 * | 9/2022 | Wu | F21S 4/28 |
| 2002/0167282 | A1 | 11/2002 | Kirkpatrick et al. | |
| 2008/0037239 | A1 | 2/2008 | Thomas | |
| 2008/0158870 | A1 | 7/2008 | Sun et al. | |
| 2008/0314944 | A1 | 12/2008 | Tsai | |
| 2009/0190350 | A1 | 7/2009 | Tseng | |
| 2010/0002426 | A1 | 1/2010 | Wu | |
| 2010/0079075 | A1 * | 4/2010 | Son | F21V 17/104 362/249.02 |
| 2010/0296285 | A1 | 11/2010 | Chemel et al. | |
| 2010/0301773 | A1 | 12/2010 | Chemel | |
| 2010/0309652 | A1 | 12/2010 | Shen et al. | |
| 2011/0075416 | A1 | 3/2011 | Chou | |
| 2011/0141723 | A1 | 6/2011 | Lai | |
| 2011/0141724 | A1 | 6/2011 | Erion | |
| 2011/0235318 | A1 | 9/2011 | Simon | |
| 2011/0286208 | A1 | 11/2011 | Chen | |
| 2011/0304270 | A1 | 12/2011 | Scarpelli | |
| 2012/0002415 | A1 * | 1/2012 | Nelson | F21V 29/76 362/235 |
| 2012/0026729 | A1 | 2/2012 | Sanchez | |
| 2012/0063138 | A1 * | 3/2012 | Leadford | F21S 2/005 362/249.02 |
| 2012/0201024 | A1 | 8/2012 | Van De Ven et al. | |
| 2012/0212953 | A1 | 8/2012 | Bloom | |
| 2012/0218757 | A1 | 8/2012 | Gill | |
| 2013/0003346 | A1 | 1/2013 | Letoquin | |
| 2013/0039041 | A1 | 2/2013 | Yeh | |
| 2013/0050998 | A1 | 2/2013 | Chu | |
| 2013/0093325 | A1 * | 4/2013 | Scarpelli | H05B 45/36 315/85 |
| 2013/0119896 | A1 | 5/2013 | Fukano | |
| 2013/0148351 | A1 | 6/2013 | Georgitsis et al. | |
| 2013/0182422 | A1 * | 7/2013 | Guilmette | F21V 7/24 362/217.05 |
| 2014/0063795 | A1 | 3/2014 | Hoffmann et al. | |
| 2014/0126190 | A1 | 5/2014 | Dixon | |
| 2014/0226321 | A1 * | 8/2014 | Halliwell | F21K 9/27 362/217.08 |
| 2014/0313711 | A1 | 10/2014 | Hwu | |
| 2015/0116997 | A1 | 4/2015 | Tappert et al. | |
| 2015/0211710 | A1 | 7/2015 | Speier | |
| 2015/0300617 | A1 | 10/2015 | Katona | |
| 2015/0345743 | A1 | 12/2015 | Trincia | |
| 2016/0201883 | A1 * | 7/2016 | Sorensen | H01R 25/14 362/225 |
| 2016/0323974 | A1 | 11/2016 | Spiro et al. | |
| 2017/0023193 | A1 | 1/2017 | Thosteson | |
| 2017/0051881 | A1 * | 2/2017 | Chamberlain | F21V 15/015 |
| 2017/0254493 | A1 | 9/2017 | Giorgini | |
| 2017/0301375 | A1 | 10/2017 | Mayhall et al. | |
| 2020/0173639 | A1 * | 6/2020 | Martin | F21V 21/048 |

FOREIGN PATENT DOCUMENTS

| | | |
|---|---|---|
| JP | 2016-157700 | 9/2016 |
| KR | 20110101592 | 9/2011 |
| WO | WO 2013/090536 | 6/2013 |
| WO | WO 2017/066642 | 4/2017 |
| WO | WO 2017/108446 | 6/2017 |

OTHER PUBLICATIONS

Examination Report issued in Appl. No. EP20205197.5 (dated Jun. 27, 2022).

Extended Search Report issued in Appl. No. EP20205197.5 (dated Mar. 5, 2021).

* cited by examiner

ELONGATED MODULAR HEATSINK WITH COUPLED LIGHT SOURCE

CROSS-REFERENCE TO RELATED APPLICATIONS

This application is continuation-in-part of co-pending U.S. application Ser. No. 17/397,508, filed Aug. 9, 2021, which is continuation-in-part of U.S. application Ser. No. 16/672,218, filed Nov. 1, 2019, now U.S. Pat. No. 11,085,622, which is continuation-in-part of U.S. application Ser. No. 16/019,329, filed Jun. 26, 2018, now U.S. Pat. No. 10,502,407, which claims benefit of U.S. Provisional Application No. 62/674,431, filed May 21, 2018. The disclosures of each of the above-mentioned applications are hereby incorporated by reference herein in their entirety.

TECHNICAL FIELD

The present disclosure generally relates to a lighting structure.

BACKGROUND

Traditional fluorescent lamps have a bulky exterior profile and consume a large amount of energy. Lighting implements, such as fluorescent lamps and others, usually have only rudimentary controls and, as such, consume excessive energy.

SUMMARY

An elongated heatsink structure of the present disclosure includes a core and unitary fins coupled to the core's exterior surfaces extending outwardly. Between the fins, at least one flat surface is configured to retain at least one light source. The light weight elongated heatsink structure's reduced profile design enables a substantial portion heat generated by a light source to be conveyed directly through the heatsink core to most of the plurality of the heat dissipating fins.

The present elongated heatsink structure is defined by a core with a plurality of unitarily heat dissipating fins coupled to the core's exterior surfaces, at least one flat surface retaining at least one light source, a bore in the core extending the longitudinal length of the elongated heatsink structure, and at least one endcap coupled to at least one end of the elongated heatsink structure. The endcap/s couple/s to lamp holder/s and is/are configured to be detachable. The endcap/s provide at least one of: a mechanical and an electrical connectivity to the elongated heatsink structure.

The elongated heatsink structure is configured to be used in existing and new luminaires. For this reason, at least one endcap connector is configured to detachably couple to a standard industry lamp holder. The endcap connector can be at least one of: G5, G13, slimline single pin and RDC lamp holder connector. The G5 and the G13 bi-pin connectors are the lighting industry's most common lamp connectors. Therefore, the elongated heatsink structure in at least one configuration is coupled to a G13 connector. Luminaire lamp holders configured to receive G5 or other connector styles can be fitted with G13 lamp holders. In addition, new designed lamp holders can be used providing additional mounting and control features.

The elongated heatsink structure's coupled light source receives its power through at least one endcap. The light source's is/are coupled to at least one exterior flat surface of the elongated heatsink structure. Power delivered to at least one light source can be is controlled by at least one of: an onboard and/or a remote processor/controller.

The elongated heatsink structure can have two endcaps, one at each end. Power or power and data can flow to both endcaps or independently of one another to each endcap. Power and/or data connectivity to both endcaps can be from both ends lamp holders or from a single lamp holder. Single end cap can convey power and/or data to the opposing side endcap through the elongated heatsink core through bore. The following articulates several examples for the elongated heatsink structure's light source power or power and data circuitry:

The elongated heatsink structure retains two light sources, one along the top surface and the other along the bottom surface. The light source/s is/are configured to operate independently of one another. The present example may employ two input power circuits—one coupled to one endcap, and the other coupled to the other endcap, wherein the first coupled endcap provides power and/or data to the top retained light source and the second endcap provides power and/or data to the bottom retained light source.

The elongated heatsink structure retains one light source coupled to the elongated heatsink structure bottom. In this configuration, power and/or power and data can be conveyed to a single endcap. This endcap provides both mechanical and electrical connectivity. At the opposite side of the elongated heatsink structure, the other coupled endcap provides mechanical connectivity only.

In another configuration, more than one type of light source is coupled to at least one lamp retaining surface of the elongated heatsink structure. Such light source types can include UV light and a white ambient light source. The two light sources can be controlled through a single endcap, or in another configuration through both endcaps. In each of the two configurations, each of the distinct light sources has a dedicated circuit.

In yet another example the elongated heatsink structure retains two light sources, one along the top surface and the other along the bottom surface. The light source(s) is/are configured to operate jointly and independently of one another. The present example may employ a single or two input power circuits. The single input power circuit conveying power through a single endcap may power both the top and bottom light sources. Using G13 bi-pins, each pin conveys power connectivity to each of the top and bottom coupled light sources. In this configuration the spacing of light sources populating one of the light source may vary from the other light source, while each light source receives the same input power.

The lamp holders' electrical and/or data circuitry at one end connect to the elongated heatsink structure's endcaps. At the other end, the circuitry connects directly or indirectly to at least one of: a power supply, a communication device, a switching device, a processing/controlling device, backup power device, an output device and a sensing device. The communication device can be wired and/or can be wireless.

For example, a luminaire can be assigned a unique address having two sub-addresses. A wireless communication device coupled to the luminaire is communicatively coupled to a remote controller. The communication device receives power from an external source, conveying signal to one sub-address. The signal received is conveyed to a microprocessor. The microprocessor's controller switches on a microswitch/relay flowing power to a light source driver and/or directing the light source driver to modulate the light source output. Another received signal is conveyed to the luminaire's other sub-address, having the same and/or different operational instructions.

The onboard processing/controlling device can be coupled to other sensing and backup power devices that can operate in unison with the remote controller and/or can operate independently. The operation of the luminaire retaining the elongated heatsink/s can be configured to respond to sensed input/s indicating that life and/or property are at risk.

Arrangements within the present disclosure replaces dated fluorescent lamp technology with LED lamp technology. Devices, systems, and methods within the present disclosure can provide the benefit of energy consumption reduction. This energy consumption reduction is due to an efficient heatsink design that can enable rapid absorption and dissipation of heat produced by high output light source having a small profile.

Devices, systems, and methods within the present disclosure can be mostly suited for medium and high mounted luminaire applications. Many of such luminaire applications can have rudimentary controls. As a result, the luminaires consume excessive energy. Devices, systems, and methods within the present disclosure can enable controlling each luminaire light source. The luminaires also can be fitted with a wired or wireless communication device using, for example, meshed Bluetooth or Zigbee communication protocols. Separately, the present innovation can replace fluorescent lamp/s and corresponding ballast/s with the elongated heatsink structure/s coupled to LED light source/s with corresponding driver/s.

BRIEF DESCRIPTION OF THE DRAWINGS

The detailed description particularly refers to the following figures, in which.

DETAILED DESCRIPTION

Figure 1C:
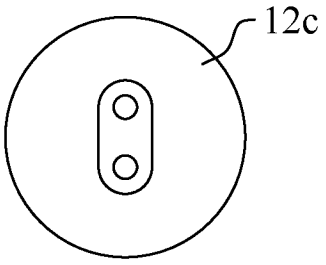
FIGS. 1A, 1B, and 1C show typical lighting industry endcap connectors.
Figure 1B:
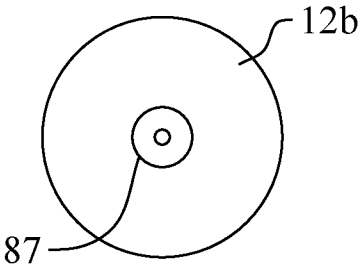
Figure 1A:
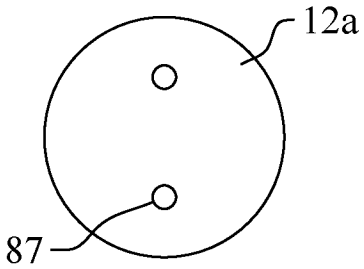

FIGS. 1A, 1B and 1C illustrate exemplary endcap electromechanical connectors 12*a*, 12*b*, 12*c*, respectively, used with fluorescent lighting devices. FIG. 1A shows a bi-pin connector 12*a* configuration, known as either G5, or G13, where G historically referred to 'glass' material used for the original bulbs and numeral after G refers to a pin spread, or pitch, of pins 87 in millimeters (mm). The G5 endcap connector is associated with the T5 fluorescent lamp and the G13 endcap connector is associated with the T8, T10, and T12 fluorescent lamps. The designation T stands for the lamp shape being 'tubular' and the numbers 5, 8, and 12 stand for the lamp's diameter divided by 8. Following this designation, the T5 lamp diameter is ⅝", the T8 lamp diameter is 1.0", and the T12 lamp diameter is 1.5".

Among the endcaps' electromechanical connectors 12*a*, 12*b*, and 12*c*, shown in FIGS. 1A, 1B and 1C, the bi-pin endcap connector 12*a* typically carries the lowest lamp wattage. Nonetheless, this endcap connector 12*a* is the most widely used endcap connector.

FIG. 1B shows a single pin connector 12*b* configuration known as Fa8. The Fa8 endcap connector is commonly used with T8, T10 and T12 lamps. The connector 12*b* wattage conveyed to the lamp ranges from normal to high output, such as with luminous flux between 1 and 12000 lumen. This connector 12*b* is coupled to F48 and F96 lamps. The F stands for 'fluorescent' and the number following "F" stands for the length of the tube measured in inches.

FIG. 1C shows a double recessed connector 12*c* configuration, known also as Recessed Direct Contact (RDC). The RDC connector 12*c* is typically used with lamps requiring high and very high power output. The RDC connector 12*c* is used with T10 and T12 lamps with length extending up to 96" (8 feet).

The light intensity output per linear foot of the present disclosure can exceed the light intensity output generated by each of the above-referenced fluorescent lamps, such as T8, T10, T12, F48, and F96, employing the G5, G13, Fa8, and the RDC endcap connectors.

Figure 2:
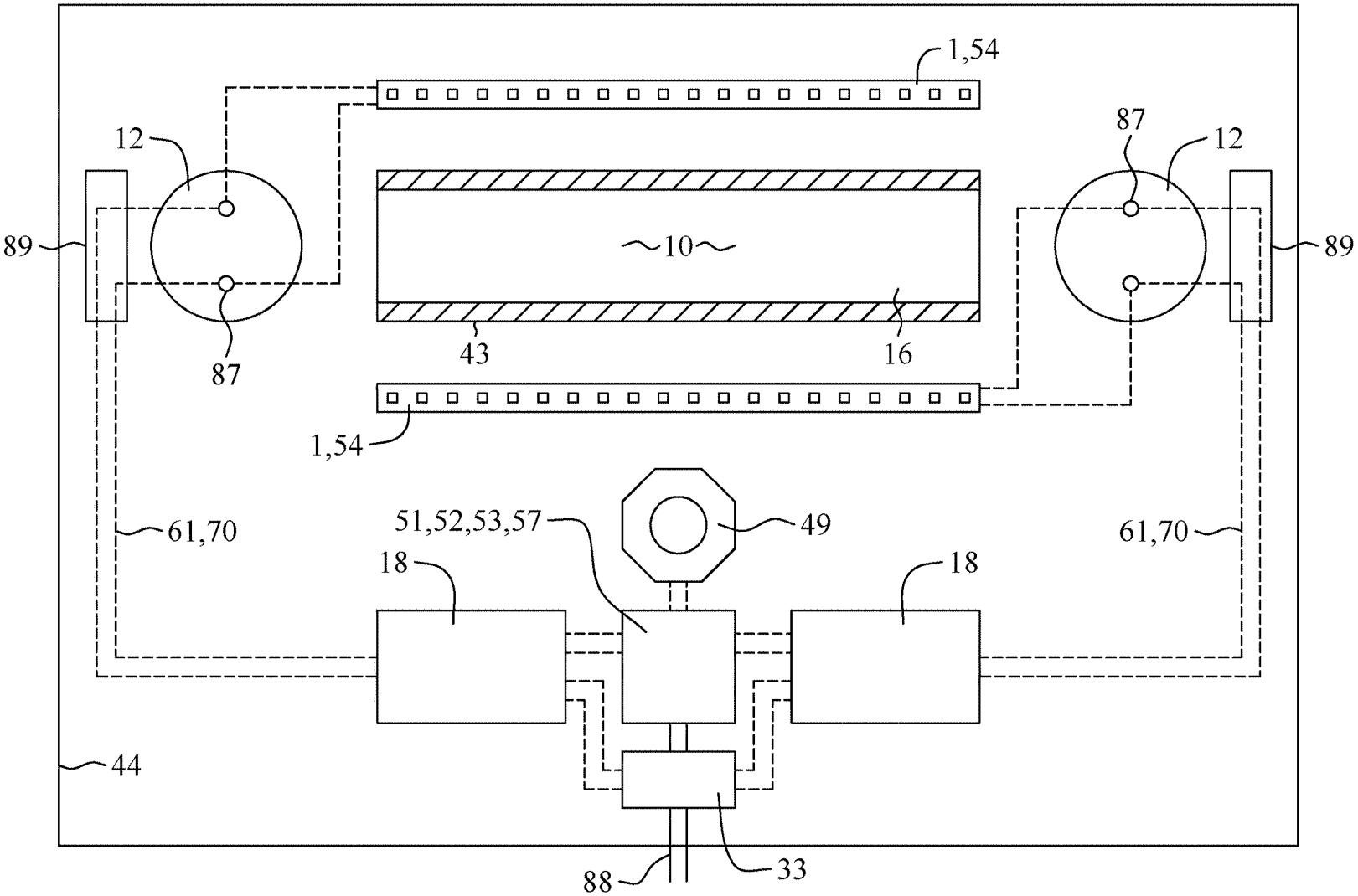
FIG. 2 shows a power/data circuitry diagram of the elongated heatsink coupled to top and bottom light sources and disposed inside a luminaire.

FIG. 2 shows a power/data circuitry diagram of an elongated heatsink structure 10 coupled to top and bottom light sources 1, 54 and disposed inside a luminaire or luminaire housing 44. House power 88 in this circuitry configuration is distributed through an enclosure/junction box 33 to two drivers 18 and at least one of: a processor/controller 51, a power management module 52, a memory storage device 53, and a communication device 57. The processor/controller 51 can be coupled to at least one sensing device 49. In an example configuration, the processor/controller 51 can be coupled to an occupancy sensor. Low voltage conductors shown between the processor/controller 51 and the sensing device 49 provide power to and carry signal from the sensing device. The low voltage conductors shown between the processor/controller 51 and the drivers 18 transmit control signal to the drivers 18. The control signal can include on/off and/or dim command. Conductors originating from each of the two drivers 18 couple to lamp holders 89 at opposite ends of the luminaire 44. The elongated heatsink structure 10 with the endcaps 12 coupled thereto at both ends, detachably couples to the lamp holders 89 engaging the endcaps' bi-pins 87 inside retaining grooves in the lamp holders 89; where element 12 illustrates an example endcap, such as, but not limited to, the endcap configurations 12*a*, 12*b*, and 12*c* described in reference to FIGS. 1A, 1B, and 1C. In the present configuration, the lamp holders 89 provide both mechanical and electrical connectivity. For illustration purposes, the example configuration of FIG. 2 shows one driver 18 providing power to one of the light sources 1, 54, e.g., the light source coupled to the top of the elongated heatsink structure 10, and another driver 18 providing power to a different one of the light sources 1, 54, e.g., the light source coupled to the bottom of the elongated heatsink structure 10. In other examples, one driver 18 can provide power to a plurality of light sources 1, 54 coupled to a plurality of elongated heatsink structures 10 disposed inside the luminaire 44. Further, the light sources 1, 54 can be locally controlled and/or be communicatively coupled to a remote controller and/or the neighboring devices.

Figure 3:
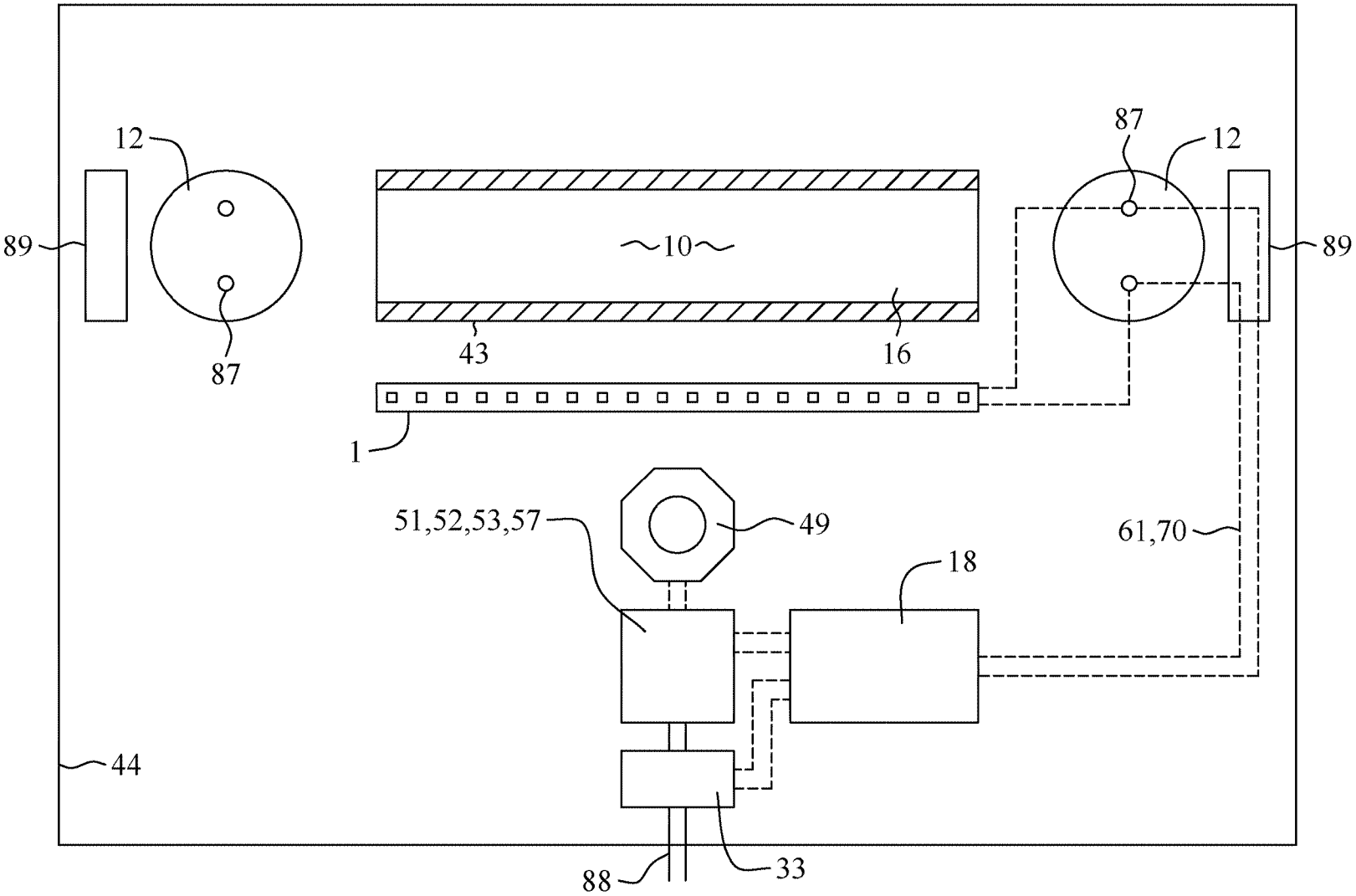
FIG. 3 shows a power/data circuitry diagram for a bottom mounted light source receiving power/data from a single endcap.
Figure 4:
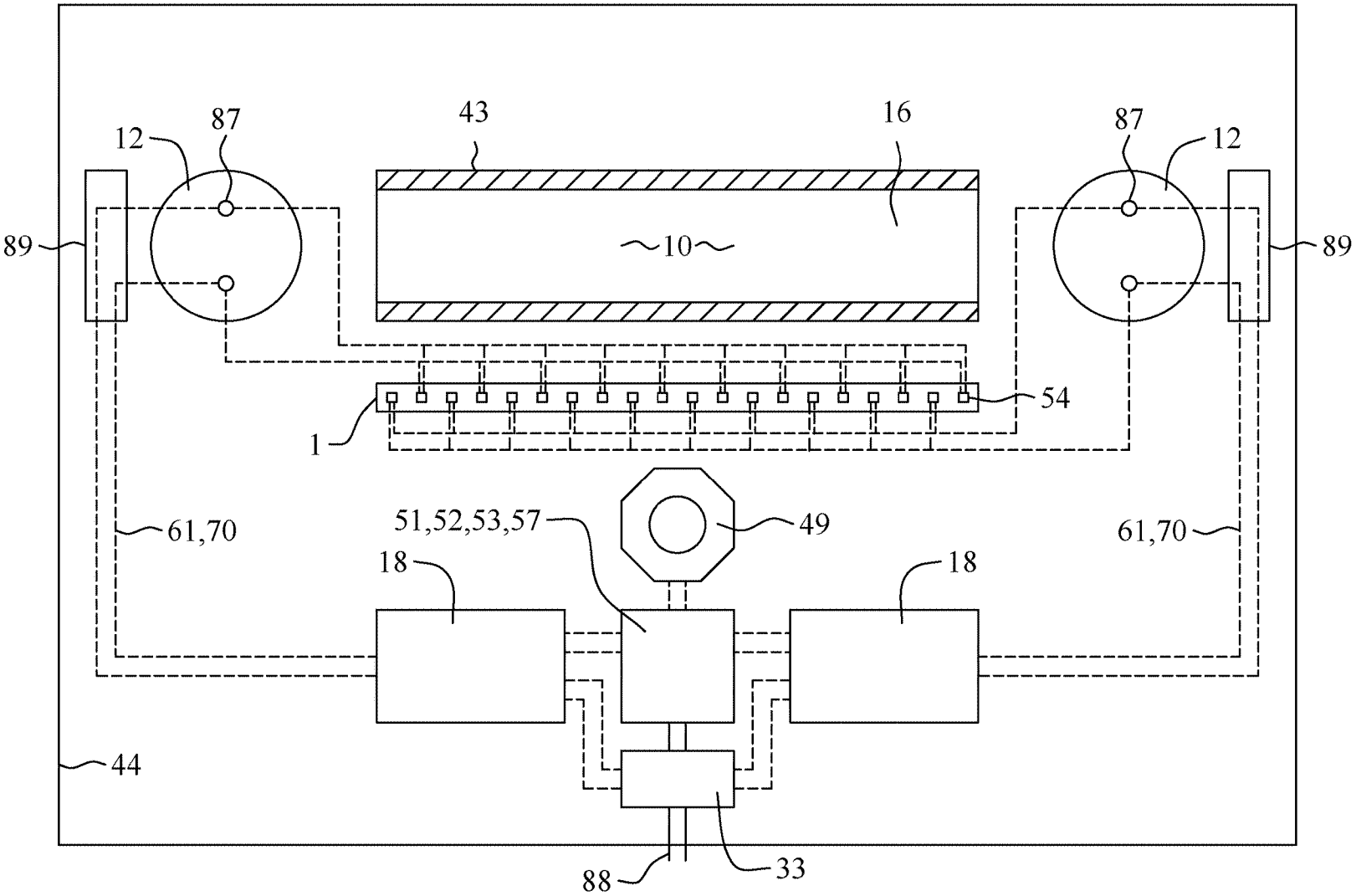
FIG. 4 shows a power/data circuitry diagram for a bottom mounted light source having different type light sources receiving power/data from two endcaps.

FIG. 3 shows a power/data circuitry diagram of the elongated heatsink structure 10 coupled to a bottom light source 1, 54 and disposed inside the luminaire 44. House power 88 in the circuitry configuration of FIG. 3 is distributed through an enclosure/junction box 33 to a single driver 18 and at least one of: a processor/controller 51, a power management module 52, a memory storage device 53, and a communication device 57. The processor/controller 51 can be coupled to at least one sensing device 49. In an example configuration the processor/controller 51 is coupled to an occupancy sensor. Low voltage conductors shown between the processor/controller 51 and the sensing device 49 provide power to and carry signal from the sensing device 49. Low voltage conductors shown between the processor/controller 51 and the driver 18 transmit control signal(s) to the driver 18. The control signal(s) can include on/off and/or dim command. Conductors originating from the driver 18 couple to lamp holders 89 at one end of the luminaire 44. This lamp holder 89 conveys power and/or data to the elongated heatsink structure 10 light source 1, also providing a mechanical connectivity for the same elongated heatsink structure 10. The lamp holder 89 disposed at the opposite end of the luminaire 44 provides mechanical connectivity for the elongated heatsink structure 10; and in some embodiments, may provide only mechanical connectivity. The pins 87 of the endcap 12 detachably couple to the lamp holders 89 by mechanically engaging retaining grooves in the lamp holders 89. For illustration purposes, the configuration of FIG. 4 shows a single driver 18 providing power and/or data to a single light source 1 coupled to the bottom surface of the elongated heatsink structure 10. Actually, the driver 18 can provide power to a plurality of light sources 1 coupled to a plurality of elongated heatsinks structures 10 disposed inside the luminaire 44. Further, the light sources 1 can be locally controlled and/or be communicatively coupled to a remote controller and/or the neighboring devices.

FIG. 4 shows a power/data circuitry diagram of the elongated heatsink structure 10 coupled to the bottom light source 1, 54 and disposed inside the luminaire 44. House power 88 in the circuitry configuration of FIG. 4 is distributed through an enclosure/junction box to two drivers 18 and at least one of: a processor/controller 51, a power management module 52, a memory storage device 53 with code 56 (such as written instructions), and a communication device 57. The processor/controller 51 can be coupled to at least one sensing device 49. In an example configuration the processor/controller 51 is coupled to an occupancy sensor. Low voltage conductors shown between the processor/controller 51 and the sensing device 49 provide power to and carry signal from the sensing device 49. Low voltage conductors shown between the processor/controller 51 and the drivers 18 transmit control signal(s) to the drivers 18. The control signal(s) can include on/off and/or dim command. Conductors originating from each of the two drivers 18 couple to the lamp holders 89 at opposite ends of the luminaire 44. The elongated heatsink structure 10, with the endcaps 12 coupled thereto at both ends, detachably couples to the lamp holders 89 engaging the pins 87 of the endcap 12 inside retaining grooves in the lamp holders 89. In the present configuration, the lamp holders 89 provide both mechanical and electrical connectivity. For illustration purposes, the configuration of FIG. 4 shows a single driver 18 providing power and/or data to a distinct light source 1 coupled to the bottom surface of the elongated heatsink structure 10 and another driver 18 providing power and/or data to a different light source 1 also coupled to the bottom surface of the elongated heatsink structure 10. The at least two light sources can include different parameters of at least one of: color temperature, color rendering index (CRI) and lumen output from those of one another. In an example, a driver 18 can provide power to a plurality of light sources 1 coupled to a plurality of elongated heatsink structures 10 disposed inside the luminaire 44. For example, the first driver provides power to "white" ambient light source wherein the other driver provides power to the UV bacteria/virus disabling light source. The control of the drivers is by the local processor/controller employing sensing device/s and is communicatively coupled to remote controller/s. Further, the light sources 1 can be locally controlled at least in part by neighboring devices.

Figure 5:
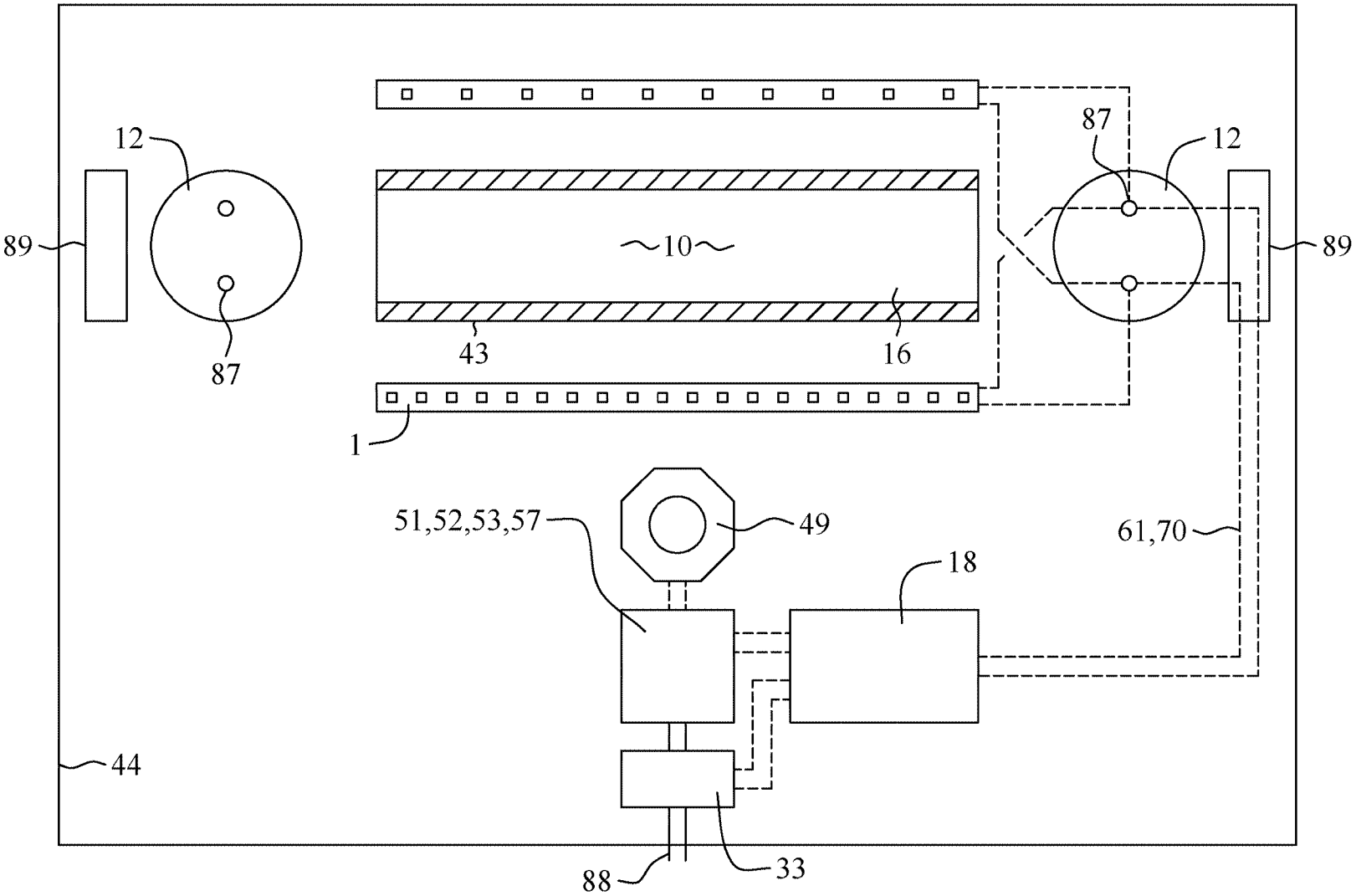
FIG. 5 shows a power/data circuitry diagram with top and bottom light sources wherein the top and bottom light sources have different spacing.

FIG. 5 shows a power/data circuitry diagram of the elongated heatsink structure 10 coupled to the top and bottom light sources 1, 54 and disposed inside the luminaire 44. House power 88 in the circuitry of FIG. 5 configuration is distributed through an enclosure/junction box to a single driver 18 and at least one of: a processor/controller 51, a power management module 52, a memory storage device 53, and a communication device 57. The processor/controller 51 can be coupled to at least one sensing device 49. In an example configuration, the processor/controller 51 is coupled to an occupancy sensor. Low voltage conductors shown between the processor/controller 51 and the sensing device 49 provide power to and carry signal from the sensing device. Low voltage conductors shown between the processor/controller 51 and the driver 18 transmit signal to the driver 18. The signal can include on/off and/or dim command. Conductors originating from the driver 18 couple to the lamp holders 89 at one end of the luminaire 44. The lamp holder 89 conveys power and/or data to the elongated heatsink structure 10 light source 1 also providing a mechanical connectivity for the same elongated heatsink structure 10. The lamp holder 89 disposed at the opposite end of the luminaire 44 provides mechanical connectivity for the elongated heatsink structure 10; and in some embodiments may only provide mechanical connectivity. The pins 87 of the endcap 12 detachably couple to the lamp holders 89 by mechanically engaging retaining grooves in the lamp holders 89. For illustration purposes, the configuration of FIG. 5 shows a single driver 18 providing power and/or data to top and bottom light sources 1 coupled to the elongated heatsink structure 10. In this example, power and/or data is conveyed by the conductor from the pins 87 of the endcap 12 to the top and bottom coupled light sources 1, 54. As shown in FIG. 5, the top LED light sources 1, 54 are spaced farther apart than the bottom coupled LED light sources 1, 54. In this example of differently spaced LED units, the driver 18 provides equal power to each of the top and bottom coupled light sources 1, 54; however, the bottom coupled light source 1, 54 is configured to generate higher light output. While this example depicts a single elongated heatsink structure 10 with two coupled light sources 1, 54, the driver 18 can provide power to a plurality of light sources 1 coupled to a plurality of elongated heatsinks structures 10 disposed inside the luminaire 44. Further, the light sources 1 can be locally controlled and/or be communicatively coupled to a remote controller and/or the neighboring devices.

While the concepts of the present disclosure are susceptible to various modifications and alternative forms, specific exemplary embodiments are been shown by way of example in the drawings and will be described. It should be understood, however, that there is no intent to limit the concepts of the present disclosure to the particular forms disclosed; on the contrary, the intention is to cover all modifications, equivalents, and alternatives falling within the spirit and scope of the invention as defined by the appended claims.

References in the specification to "one embodiment," "an embodiment," "an illustrative embodiment," etc., indicate that the described embodiment may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Additionally, it should be appreciated that items included in a list in the form of "at least one A, B, and C" can mean (A); (B); (C): (A and B); (B and C); (A and C); or (A, B, and C). Similarly, items listed in the form of "at least one of A, B, or C" can mean (A); (B); (C): (A and B); (B and C); (A and C); or (A, B, and C).

The disclosed embodiments may be implemented, in some cases, in hardware, firmware, software, or any combination thereof. The disclosed embodiments may also be implemented as instructions carried by or stored on one or more transitory or non-transitory machine-readable (e.g., computer-readable) storage medium, which may be read and executed by one or more processors. A machine-readable storage medium may be embodied as any storage device, mechanism, or other physical structure for storing or transmitting information in a form readable by a machine (e.g., a volatile or non-volatile memory, a media disc, or other media device).

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, may not be included or may be combined with other features.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

| Element List |
|---|
| 1 Light source |
| 3 Rack |
| 4 Ceiling |
| 5 Floor |
| 10 Heat sink |
| 11 Light source modules |

-continued

| Element List |
|---|
| 12 Endcap receptacle |
| 13 Fin/s |
| 14 Mechanical key |
| 15 Conductor(s) |
| 16 Bore |
| 18 Driver and/or another device/s |
| 33 J box |
| 34 J box cover |
| 35 Release button/latch |
| 36 Conduit |
| 37 Power or power and data receptacle |
| 39 Knockout opening |
| 40 Cable or chain hanging opening |
| 41 Anchoring protrusion |
| 43 Heatsink core |
| 44 Luminaire |
| 47 Power or power and data entry |
| 49 Occupancy sensor |
| 51 Processor/controller |
| 52 Power management module/power supply |
| 53 Memory storage device |
| 54 UV/GUV light source |
| 55 Camera |
| 56 Code |
| 57 Communication device |
| 58 Micro switch |
| 59 Indicator light |
| 60 Sound emitting/receiving device |
| 61 Power and/or data conductor |
| 62 Electronic device |
| 63 Wireless device |
| 64 Plate joiner |
| 65 Sensing device |
| 66 Saddle joiner |
| 67 Hanger |
| 68 Dip switch |
| 70 Local power and/or power and data conductor |
| 71 Mechanical fastener |
| 72 Slotted bore |
| 73 Keyed joiner opening |
| 74 Mechanical protrusion/s |
| 75 Device receptacle |
| 76 Device power and data port |
| 77 Receptacle recess |
| 78 Saddle wall, vertical wall |
| 79 Saddle device mounting surface |
| 80 Joiner top surface |
| 81 Joiner bottom surface |
| 82 Plate top surface |
| 83 Plate bottom surface |
| 84 Dip switch opening |
| 85 Through line power and/or data |
| 86 Local power and/or data |
| 87 Pin |
| 88 House power |
| 89 Lamp holder |

The invention claimed is:

1. A structure comprising:

an elongated heatsink that is unitarily formed and displays a solid core with a longitudinal opening extending from one end of the elongated heatsink to the other end;

a plurality of heat dissipating fins unitarily coupled to the core of the elongated heatsink;

a plurality of light sources coupled to at least one exterior surface of the elongated heatsink;

a conductor that extends a length of the longitudinal opening of the elongated heatsink; and an endcap that is electrically coupled to at least one end of the elongated heatsink, wherein a portion of heat generated by at least one of the plurality of light sources is conveyed through the core of the elongated heatsink directly to most of the plurality of the heat dissipating fins, and the endcap includes a circuitry that conveys power and/or data to at least one of the plurality of light sources.

2. The elongated heatsink structure of claim 1, wherein intensity output of at least one of the plurality of light sources exceeds intensity output of another one of the plurality of light sources of a common elongated heatsink structure.

3. The elongated heatsink structure of claim 1, wherein at least one of the plurality of light sources can be independently controlled for at least one of on/off, dimming, and/or color operation modulation.

4. The elongated heatsink structure of claim 1, wherein at least one of: a color temperature and/or a color rendering index (CRI) of one of the plurality of light sources is different from that of another one of the plurality of light sources.

5. The elongated heatsink structure of claim 1, wherein at least one of the plurality of light sources emits photonic energy having wavelength within the ultraviolet spectrum.

6. The elongated heatsink structure of claim 5, further comprising at least one processor coupled to at least one of: a communication device, a sensing device, a power storage device, and an output device.

7. The elongated heatsink structure of claim 6, wherein the at least one processor is coupled to the communication device and at least one of: the sensing device, the power storage device, and the output device, such that the at least one of the sensing device, the power storage device, and the output device is addressable by the communication device for at least one of power, data, or a combination of both.

8. A structure comprising:

an elongated heatsink that is unitarily formed and displays a solid core with a longitudinal opening extending from one end of the elongated heatsink to the other end;

a plurality of heat dissipating fins unitarily coupled to the core of the elongated heatsink;

a plurality of light sources coupled to at least one exterior surface of the elongated heatsink;

at least one conductor that extends a length of the opening in the elongated heatsink; and an endcap that is electrically coupled to at least one end of the elongated heatsink, wherein a portion of heat generated by the at least one of the plurality of light sources is conveyed through the solid core of the elongated heatsink directly to most of the plurality of the heat dissipating fins, and the endcap provides electrical connectivity to the elongated heatsink, and conveys power and/or data to at least two of the plurality of light sources which are disposed at opposing sides of the elongated heatsink.

9. The elongated heatsink structure of claim 8, wherein at least one light source output exceeds another coupled light source of a common elongated heatsink structure.

10. The elongated heatsink structure of claim 8, wherein at least one light source can be independently controlled for at least one of on/off, dimming, and/or color operation modulation.

11. The elongated heatsink structure of claim 8, wherein at least one of: a light color temperature and/or a color rendering index (CRI) of one of the at least one light source of the plurality of light sources is different from that of another of the at least one light source of the plurality of light sources.

12. The elongated heatsink structure of claim 8, wherein at least one light source of the plurality of light sources at least one light source emits photonic energy in an the bandwidth of ultraviolet band.

13. The elongated heatsink structure of claim 8, wherein further comprising at least one processor coupled to at least one of: a communication device, a sensing device, a power storage device, and an output device, as at least one coupled device.

14. The elongated heatsink structure of claim 13, wherein the at least one coupled device is addressable by the communication device.

15. An elongated heatsink structure comprising:

a heatsink that is unitarily formed and displays a solid core with a longitudinal opening extending from one end of the heatsink to the other end;

a plurality of heat dissipating fins unitarily coupled to the core of the heatsink;

a plurality of light sources coupled to at least one exterior surface of the heatsink;

at least one conductor that extends the length of the opening in the heatsink; and an endcap that electrically is electrically coupled to at least one end of the heatsink, wherein a portion of heat generated by the at least one light source of the plurality of light sources is conveyed through the solid core of the heatsink directly to most of the plurality of the heat dissipating fins, and the endcap provides electrical connectivity to the elongated heatsink structure, and conveys power and/or data to different light sources of the plurality of light sources that are disposed on a same retaining surface of the elongated heatsink structure.

16. The elongated heatsink structure of claim 15, wherein the at least one light source can be independently controlled for at least one of on/off, dimming, and/or color operation modulation.

17. The elongated heatsink structure of claim 15, wherein at least one of: a light color temperature and/or a color rendering index (CRI) of one of the at least one light source of the plurality of light sources is different from that of another of the at least one light source of the plurality of light sources.

18. The elongated heatsink structure of claim 15, wherein at least one light source of the plurality of light sources at least one light source emits photonic energy in an the bandwidth of ultraviolet band.

19. The elongated heatsink structure of claim 15, wherein further comprising at least one processor coupled to at least one of: a communication device, a sensing device, a power storage device, and an output device, as at least one coupled device.

20. The elongated heatsink structure of claim 19, wherein the at least one coupled device is addressable by the communication device for at least one of power, data, or a combination of both.

* * * * *